US005251819A

United States Patent [19]

McHugh

[11] Patent Number: 5,251,819

[45] Date of Patent: Oct. 12, 1993

[54] COLLAPSIBLE CONTAINER FOR EASE OF DISPOSAL

[76] Inventor: Sandra McHugh, 3804 E. Lake Ter., Hollywood, Fla. 33023

[21] Appl. No.: 845,389

[22] Filed: Mar. 3, 1992

[51] Int. Cl.[5] ..... B65D 5/54

[52] U.S. Cl. ..... 229/236; 53/382.1; 229/117.01; 493/183

[58] Field of Search ..... 229/236, 240, 243, 201, 229/235, 117.5, 117.01, 121, 122.2, 224; 53/382; 493/59, 128, 156, 183

[56] References Cited

U.S. PATENT DOCUMENTS

| | | | |
|---|---|---|---|
| 2,822,118 | 2/1958 | Will | 229/243 |
| 2,891,713 | 6/1959 | O'Neil | 229/201 |
| 3,773,248 | 11/1973 | Cecil et al. | 229/235 |
| 3,850,363 | 11/1974 | Jacobs | 229/240 |
| 4,573,634 | 3/1986 | Kohler et al. | 229/240 |
| 4,770,338 | 9/1988 | Tatusch | 229/240 |
| 4,773,541 | 9/1988 | Riddell | 229/235 |
| 4,789,067 | 12/1988 | Silano | 229/236 |

*Primary Examiner*—Gary E. Elkins

*Attorney, Agent, or Firm*—Malin, Haley, DiMaggio & Crosby

[57] ABSTRACT

A collapsible container for disposal provided. The container contains a body member, top member and bottom member. The body member has an upper and lower portion. The top member is connected to the upper portion, while the bottom member is connected to the lower portion. The design of the body member permits the top and bottom member to be opened. For disposal purposes, once the top and bottom members are opened, the body member is folded upon itself and then over itself. The bottom member is then folded over the body member and the top member is folded over the bottom member.

15 Claims, 4 Drawing Sheets

Prior Art

COLLAPSIBLE CONTAINER FOR EASE OF DISPOSAL

BACKGROUND OF THE INVENTION

1. Field of the Invention

The present invention relates generally to containers and more particularly to a container which is easily opened, collapsible and foldable for disposal and recyclable purposes.

2. Description of the Prior Art

Cardboard containers are known in the art. Exemplary of these containers are U.S. Pat. No. 3,136,474 to Schaus; U.S. Pat. No. 2,904,239 to Wilcox; U.S. Pat. No. 2,218,509 to Goodyear and U.S. Pat. No. 4,328,924 to Neff. Also known in the art are containers used for shipping and display purposes. Such as U.S. Pat. No. 4,784,271 to Wosaba; U.S. Pat. No. 4,558,785 to Gordon; U.S. Pat. No. 4,778,059 to Martin and U.S. Pat. No. 4,773,541 to Riddell. Many of the aforementioned containers utilize tear strips for opening the container. Exemplary of these tear strips is U.S. Pat. No. 3,708,104 to Buttery. U.S. Pat. No. 809,050 to Goldman teaches an alternative to the tear strip.

While a number of these containers are provided with a method to ease opening, none of these containers provide a means to ease disposal. Further, conventional containers require a knife or razor blade to open and break down for disposal. For instance, in a typical grocery store, an employee is hired full time to specifically cut open and break down boxes. This cutting operation presents a risk of injury to the employee and to the goods inside. Additionally, the knife must be replaced when it becomes dull, an additional and unnecessary cost.

Thus, the problem with conventional containers is the lack of simplicity in opening and disposal once the container is opened. Prior art attempts to deal with the opening problem, but fails to deal with disposal. The use of a knife to cut up the container in order to fold and break down the container presents cost and safety problems to which this invention is addressed.

SUMMARY OF THE INVENTION

The present invention relates to an improved container, or the like, which is easily opened and easily broken down. The container generally includes a body member, a top member, and a bottom member. The top and bottom members are attached and sealed to the body in accordance with conventional practices such as glue, tape or staples. In the preferred embodiment, the body member includes a top tear strip located near the upper edge or portion of the body member, and a bottom tear strip located near the lower edge or portion of the body member. Top and bottom tear strips are present on at least three of the four walls of the body member. Preferably, top and bottom tear strips will be present on the front and two side walls.

The use of the improved container is similar to known art, however, breakdown of the container simply requires removal of top and bottom tear strips. Removal of the top tear strip will cause the top member to separate from the body member along the perforation line. Once the top member has been separated from the body member, the contents within the container can be removed. In the preferred embodiment, the top member will remain hingedly connected to the top of rear wall of the body member, thus a reclosable lid.

When it is desired to dispose of the container, the bottom member is separated from the body member in a similar manner as the top member. Thus, removal of the bottom tear strip causes the bottom member to separate from the body member along the bottom perforation line. In the preferred embodiment, the bottom member will remain hingedly connected to the bottom of rear wall of the body member.

Once the top and bottom members are separated from the body member, the body member is folded upon itself. This is possible as the lack of top and bottom member support allows either side wall to fold against the back wall and then again fold over upon itself. After the body member is folded, the top member and the bottom member are folded over the body member. Thus, the bulky container is reduced to a compact item for disposal, storage or recycling purposes.

Accordingly, it is an object of the present invention to provide a collapsible container which can easily be broken down for disposal purposes.

It is yet another object of the present invention to provide a collapsible container which can easily be broken down without the use of cutting objects.

It is still another object of the present invention to provide a collapsible container which can easily be opened without the use of cutting objects.

It is yet another object of the present invention to provide a one piece collapsible container which is relatively low in cost for the tear strips are incorporated during manufacturing.

It is a further object of the present invention to reduce bulk solid waste in the environment.

In accordance with these and other objects which will be apparent hereinafter, the instant invention will now be described with particular reference to the accompanying drawings.

DETAILED DESCRIPTION OF THE PREFERRED EMBODIMENT

Figure 1:
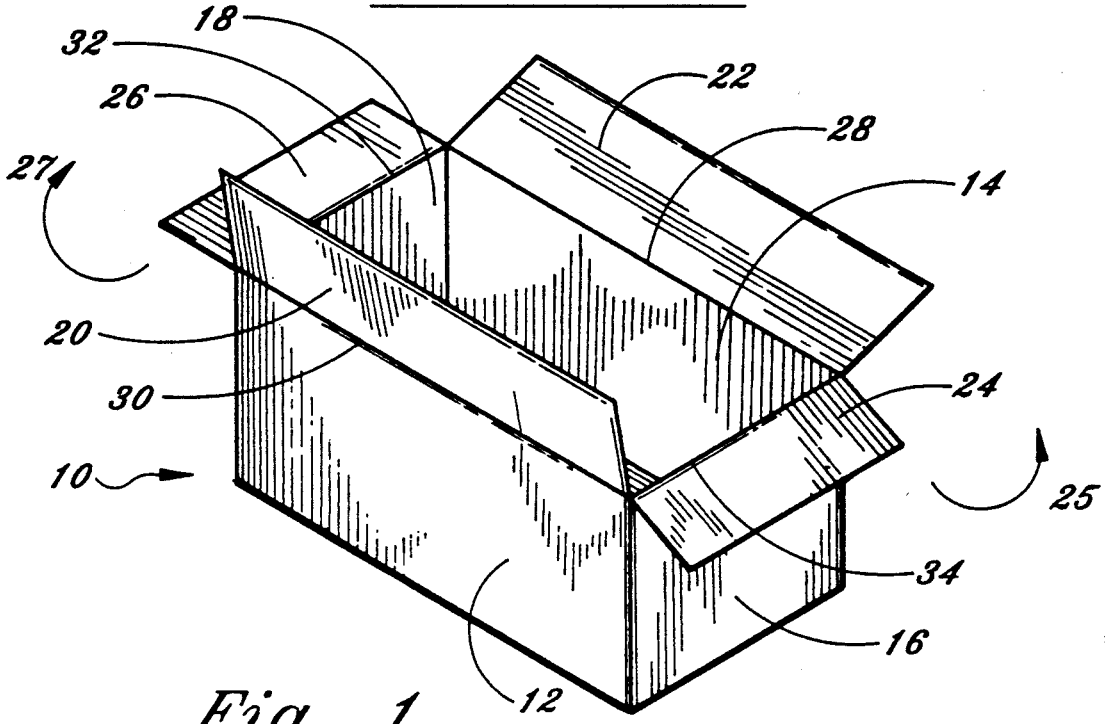
FIG. 1 is a perspective view of a prior art box.

Referring now to the drawings, a prior art container 10 is generally shown in FIG. 1. Prior art container 10 contains a body member having a front wall 12, rear wall 14 and side walls 16 and 18. Flap 20 is hingedly connected along the top of front wall 12 at fold line 30. Flap 22 is hingedly connected along the top of rear wall 14 at fold line 28. Flap 24 is hingedly connected along the top of first side wall 16 at fold line 34. Flap 26 is hingedly connected along the top of second side wall 18 at fold line 32. Though not shown, container 10 will similarly contain flaps along the bottom of front wall 12, rear wall 14 and side walls 16 and 18.

To seal the container 10, flaps 24 and 26 are folded in the direction of arrows 25 and 27 along fold lines 34 and 32, respectively. Glue or other adhesive material is applied to the exposed surface of flaps 24 and 26 and to the associated surface of flaps 20 and 22. Once the glue is applied, flaps 20 and 22 are folded along fold lines 30 and 28, respectively, over flaps 24 and 26, thus sealing the container. The bottom of container 10 is similarly sealed. Typically, an additional packing tape (not shown) is wrapped around flaps.

To open sealed container 10, a knife or the like cutting tool (not shown) is used to cut the packing tape and the top of container 10. Once opened, the contents of container 10 can be removed. The bottom of container 10 remains sealed. Once the contents are removed, container 10 is usually broken down for disposal purposes. Because the bottom of container 10 is sealed, container 10 cannot be easily, safely, and quickly broken down. Typically, the knife is again used to cut the container in several small pieces.

Figure 2:
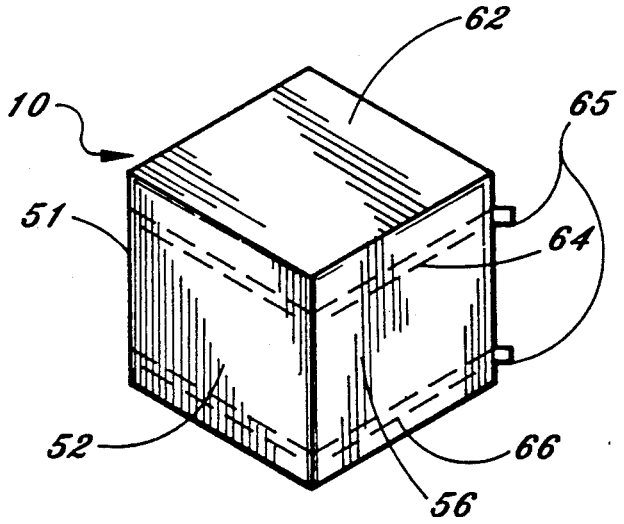
FIG. 2 is a perspective view of a box according to the present invention in a sealed condition.
Figure 3:
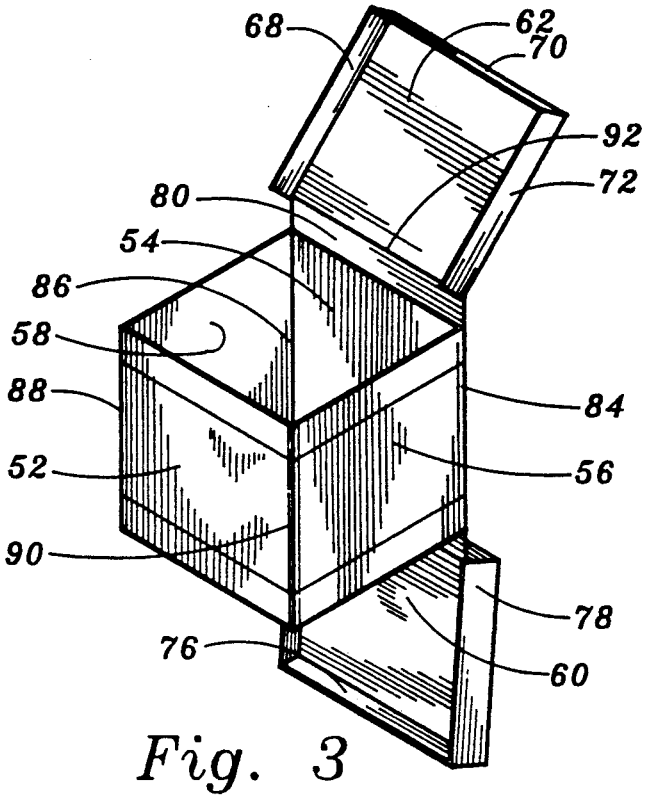
FIG. 3 is a perspective view of the box shown in FIG. 2 after the top and bottom members are opened.
Figure 4:
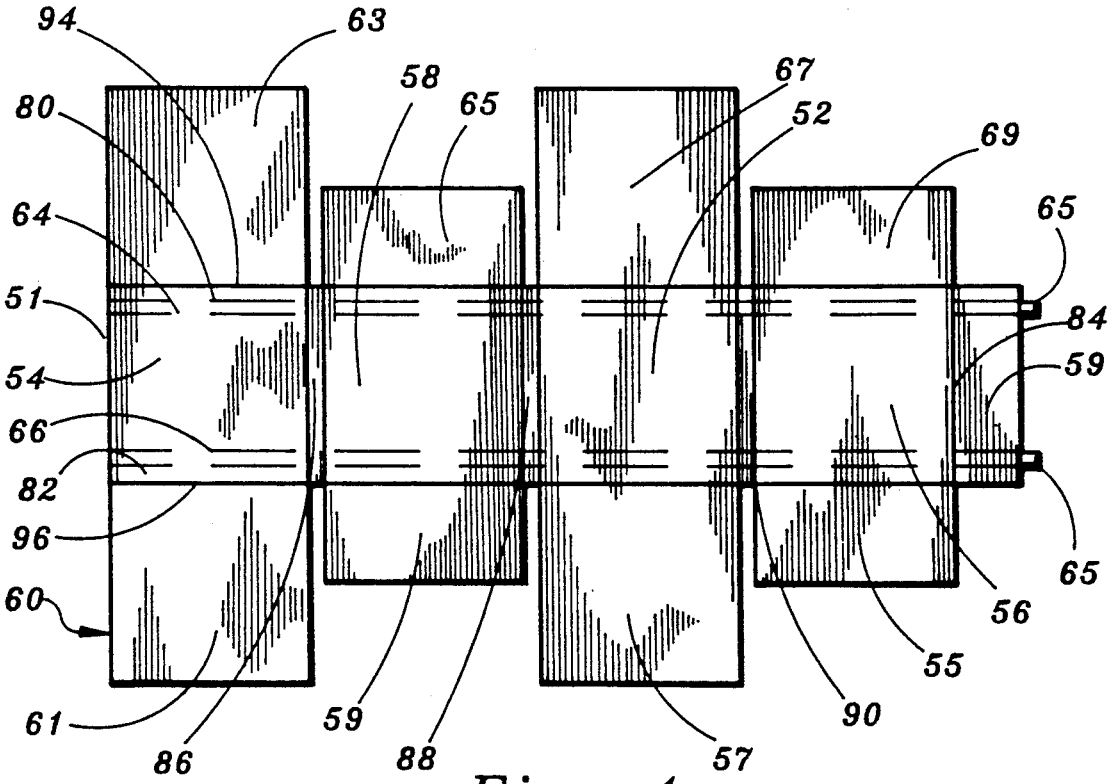
FIG. 4 is a plan view of a box blank used to construct the box of the present invention.

Referring now to FIGS. 2 through 4, the present invention is generally shown as container 50, it is to be understood that container 50 can be a box, carton or the like packaging product. The container can be cut from a single parent sheet of suitable material such as cardboard. Alternatively, the box can consist of an inner and outer body member attached to each other by conventional means. In this alternative embodiment, the top and bottom members will be attached to the outer body member. The top and bottom tear strips, described below, will extend on the outer body, but not the inner body. Alternatively, the top and bottom tear strips can be operatively associated with both the inner and outer body.

As seen in FIG. 4, body member 51 includes a front wall 52, rear wall 54, and a first and second side wall 56 and 58, all integrally connected. Tab 59 is integrally connected to side wall 56. As depicted in FIG. 3, tab 59 connects side wall 56 to rear wall 54 when constructing box 50. Glue or other adhesive material is applied to a surface of tab 59 and to an associated portion of rear wall 54. After the glue is applied, tab 59 and the associated portion of rear wall 54 are mated together to provide a secure body 51 construction. Top 62 and bottom 60 are sealed to respective top and bottom edges of body member 51 in accordance with conventional practices, such as the description of sealing prior art container 10 of FIG. 1. A first fold line 88 is present between front wall 52 and side wall 58. A second fold line 86 is present between side wall 58 and rear wall 54. A third fold line 84 is present between rear wall 54 and side wall 56. A fourth fold line 90 is present between side wall 56 and front wall 52.

FIG. 2 depicts top tear strip 64 shown near the upper portion of body member 51. Preferably, a top tear strip 64 is present on at least three walls of body member 51. However, it is to be understood that top tear strip can be present on all four walls, including tab 59. In the preferred embodiment, top tear strip 64 is present on front wall 52 and side walls 56 and 58. However, this is not meant by limitation, and any combination of three walls of body member 51 can be utilized. The preferred embodiment is chosen to avoid having to provide tear strip 64 on tab 59. Similarly, a bottom tear strip 66 is provided on body member 51. When tear strips are provided only on three walls of body 51, top and bottom tear strips 64 and 66 should be located on the same three walls. Though tear strips 64 and 66 are chosen in the preferred embodiment, any means which will release top member 62 and bottom member 60 from its sealed relationship with body member 51 can be utilized. Alternative release means include, but are not limited to, perforations, wire within and extending the length of the walls, tear tape, and the like.

When it is desired to open container 50, top tear strip 64 is removed by pulling on top pull tab 65 causing top member 62 to open or more specifically be released from its sealed relationship with the top portion or edge of body member 51. Alternatively, if perforations are utilized instead of tear strips, hand pressure on top perforations 64 will open top member 62. As seen in FIG. 3, top member 62 is shown hingedly connected to rear wall 54 by lip 80. Once opened, top member 62 will have top front flange member 70 and top side flange members 68 and 72 depending therefrom. Before top tear strip 64 was removed, top flange members 70, 68 and 72 were the uppermost wall portions of front wall 52 and side walls 58 and 56, respectively. Once top tear strip 64 is removed, top flange members 70, 68 and 72 separate from front wall 52 and side walls 58 and 56, respectively, and remain connected to top member 62. Once the top member 62 is opened, the contents can be removed from the container 50. Once the contents are removed, container 50 is ready for collapsing, disposal and/or recycling purposes.

Also seen in FIG. 3, when disposal of container 50 is desired, bottom member 60 is released from its sealed relationship with the bottom portion of body member 51. To release bottom member 60, bottom tear strip 66 is removed in a similar fashion as described above for top tear strip 64. Thus, a bottom pull tab 67 is pulled causing bottom tear strip 66 to be removed and bottom member 60 to open. Bottom member 60 is hingedly connected to rear wall 54 by lip 82. Once opened, bottom member 60 will have bottom front flange member 76 and top side flange members 74 and 78 depending therefrom. Before bottom tear strip 66 was removed, bottom flange members 76, 74 and 78 were the lowermost wall portions of front wall 52 and side walls 58 and 56, respectively. Once bottom tear strip 66 is removed, bottom flange members 74, 76 and 78 separate from front wall 52 and side walls 58 and 56, respectively, and remain connected to bottom member 60.

Figure 5:
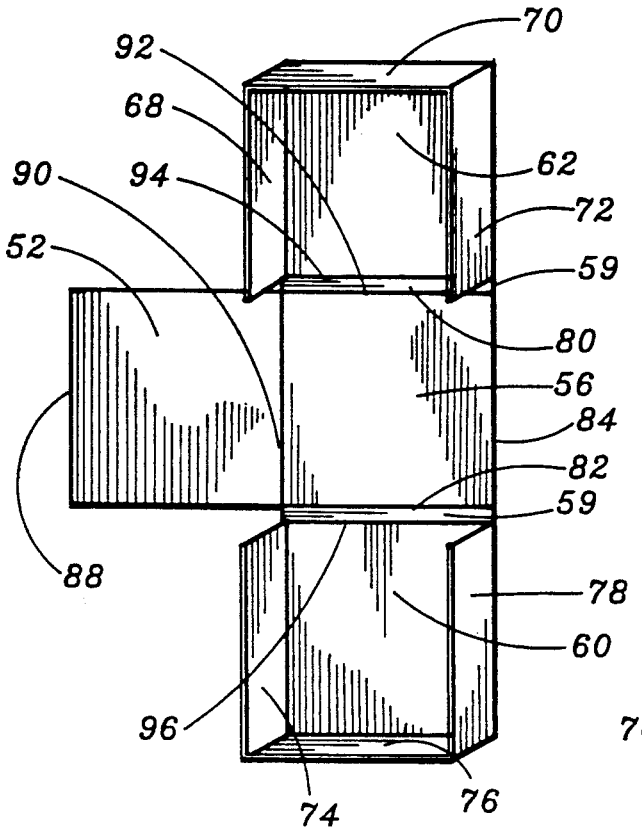
FIG. 5 is a perspective view of the box shown in FIG. 3 having its body portion folded back upon itself.

After bottom member 60 is opened, as shown in FIG. 5, body member 51 is folded upon itself, by applying pressure, such as hand pressure, on body member 51. Pressure on body member 51 collapses the container 50 structure along fold lines 88 and 84. Alternatively, the container can be collapsed along fold lines 86 and 90. Once collapsed, container 50 is substantially flat with front wall 52 mating with side wall 58 and side wall 56 mating with rear wall 54.

Figure 6:
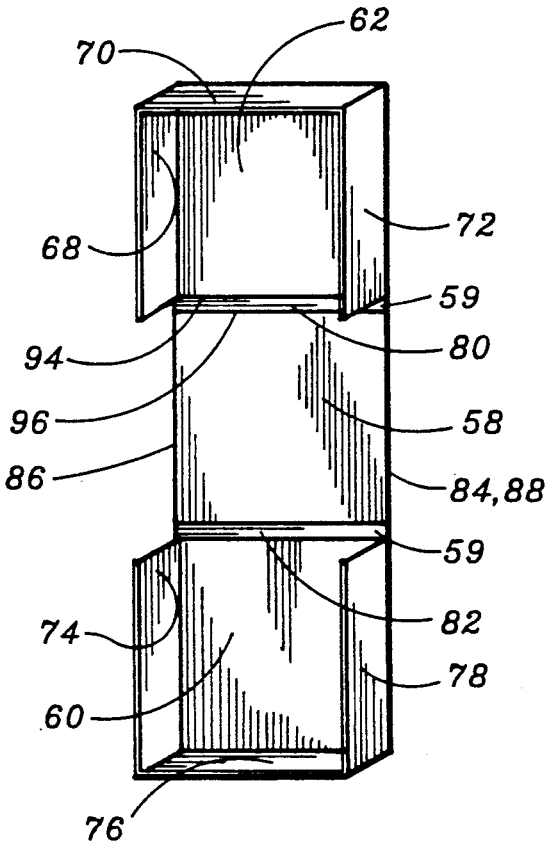
FIG. 6 is a perspective view of the box shown in FIG. 5 having its body portion folded over itself.

Once body member 51 has been folded upon itself, as described above, body member 51 is folded over itself along fold lines 86 and 90. Preferably, body member 51 is folded over itself by hand, however, alternatives may be utilized and are within the scope of the present invention. As seen in FIG. 6, in this position walls 52, 54, 56 and 58 are mating with each other.

Figure 7:
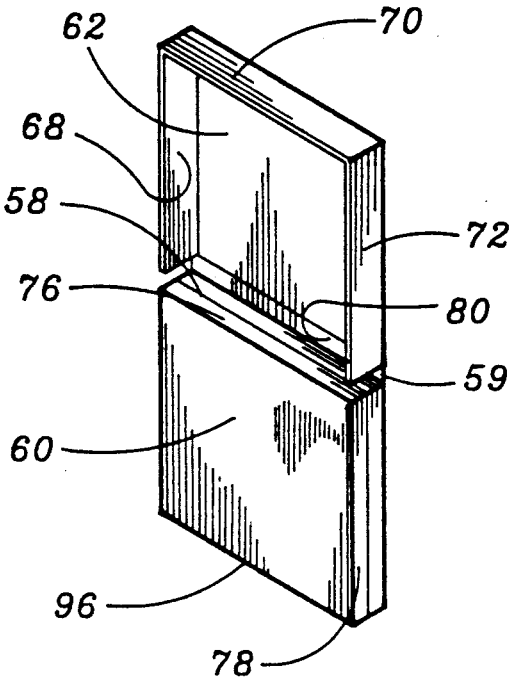
FIG. 7 is a perspective view of the box shown in FIG. 6 having its bottom portion folded over the body portion.

Once body member 51 has been folded over itself, as described above, bottom member 60 is folded over body member 51 along fold line 96. Alternatively, top member 62 can be folded over body member 51, along fold line 94, before bottom member 60 is folded. However, by way of example and illustration, bottom member 60 will be folded over body member 51 first. Preferably, bottom member 60 is folded over body member 51 by hand, however, alternatives may be utilized and are within the scope of the present invention. As seen in FIG. 7, bottom member 60 is mating with body member 51. Also seen in FIG. 7, by folding bottom member 60 over body member 51, bottom flanges 74, 76 and 78 tend to flatten by contact with body member 51.

Figure 8:
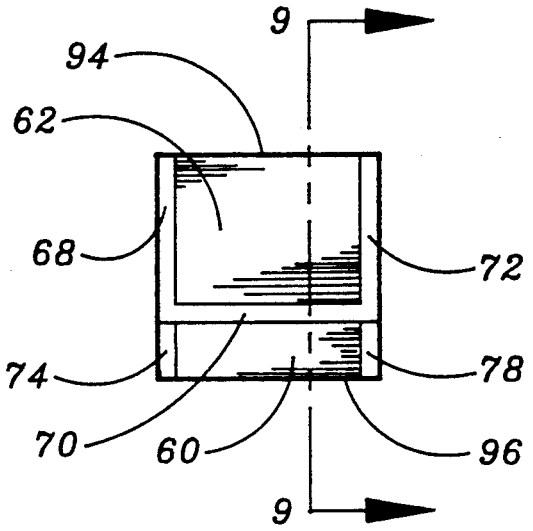
FIG. 8 is a perspective view of the box shown in FIG. 7 having its top portion folded over the bottom portion and the body portion.
Figure 9:
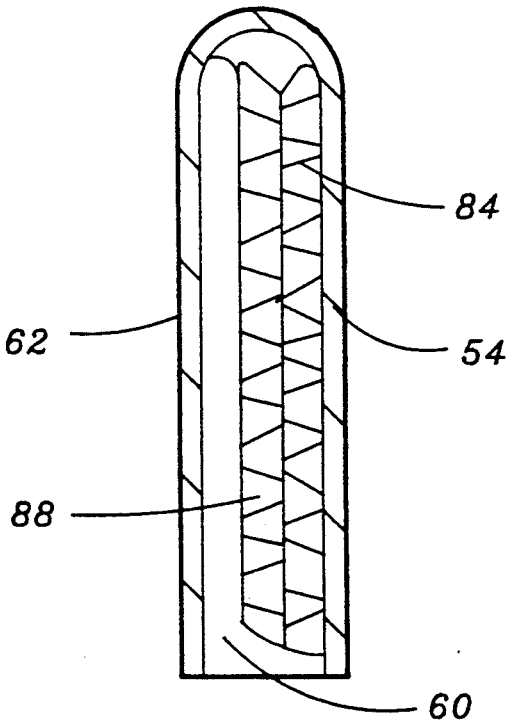
FIG. 9 is a side view of the box shown in FIG. 8 taken along section lines 9—9.

Once bottom member 60 is folded over body member 51, as described above, top member 62 is folded over body member 51 and bottom member 60 along fold line 94. Preferably, top member 62 is folded over body member 51 and bottom member 60 by hand, however, alternatives may be utilized and are within the scope of the present invention. After folding, top member 62 is mating with body member 51 and bottom member 60. As seen in FIG. 8, by folding top member 62 over body member 51 and bottom member 60, top flanges 68, 70 and 72 tend to flatten by contact with body member 51 and bottom member 60.

It is to be understood that numerous folding sequences can be utilized with the present invention without varying from the scope and spirit of the present invention. Additionally, the present invention can be utilized with boxes of various shapes and sizes without varying from the scope and spirit of the present invention.

While the instant invention has been described in what is considered to be the preferred embodiment, it is to be understood that these descriptions are given by means of example only, and not by means of limitation. It is to be understood that changes and modifications may be made to the description given and still be within the scope of the invention. Further, it is clear that obvious changes and modifications will occur to those skilled in the art.

What is claimed is:

1. A collapsible container for disposal purposes, comprising:

a body member, said body member having an upper and lower edge;

a top member hingedly connected to said upper edge of said body member;

a bottom member hingedly connected to said lower edge of said body member;

means for opening said top member disposed near said upper edge of said body member, said means for opening said top member including a top tear strip along said upper edge of said body member, said top tear strip having a first end and a second end, said top tear strip having a top pull tab attached at said first end; and means for opening in said bottom member disposed near said lower edge of said body member said means for opening said bottom member including a bottom tear strip along said lower edge of said body member, said bottom tear strip having a first end and a second end, said bottom tear strip having a bottom pull tab attached at said first end; and means for collapsing said body member once said top member and said bottom member having been opened.

2. The container of claim 1, wherein said body member is further defined as a front wall, rear wall and a first and second side wall of equal dimensions.

3. The container of claim 2, wherein said body member further comprises a first fold line between said front wall and said first side wall, a second fold line between said first side wall and said rear wall, a third fold line between said rear wall and said second side wall, and a fourth fold line between said second side wall and said front wall, said fold lines dividing said body member into four equal sections.

4. The container of claim 1, wherein to open said top member, said top tear strip is removed by pulling said top pull tab.

5. The container of claim 1, wherein to open said bottom member, said bottom tear strip is removed by pulling said bottom pull tab.

6. The container of claim 1, further including means for folding said body member upon itself and means for folding said body member over itself once said body member has been folded upon itself.

7. The container of claim 1, further including means for folding said body member over itself and means for folding said body member upon itself once said body member has been folded over itself.

8. A collapsible container for disposal purposes, comprising:

a body member, said body member having a front wall, rear wall, and a first and second side wall, said walls having upper and lower edges;

a top member hingedly connected to said upper edge of said walls;

a bottom member hingedly connected to said lower edge of said walls;

means for opening said top member disposed near said upper edge of at least three of said walls, said means for opening said top member including a top tear strip along said upper edge of said body member, said top tear strip having a first end and a second end, said top tear strip having a top pull tab attached at said first end;

means for opening said bottom member disposed near said lower edge of at least three of said walls, said means for opening said bottom member including a bottom tear strip along said lower edge of said body member, said bottom tear strip having a first end and a second end, said bottom tear strip having a bottom pull tab attached at said first end; and means for collapsing said body member once said top member and said bottom member have been opened.

9. The container of claim 8, further including means for folding said body member upon itself and means for folding said body member over itself once said body member has been folded upon itself.

10. The container of claim 8, further including means for folding said body member over itself and means for folding said body member upon itself once said body member has been folded over itself.

11. A method for manufacturing a collapsible container for disposal purposes, said container having a body member, top member and bottom member, said body member having an upper and lower edge, said top member hingedly connected along said upper edge of said body member, said bottom member hingedly connected along said lower edge of said body member, comprising the steps of:

cutting a container blank into a container form;

placing fold lines on said container form;

providing top and bottom tear strips on said container form;

forming a container configuration from said container form;

inserting articles into said container;

sealing said top and bottom members to said body member;

opening said top member at said upper edge;

opening said bottom member at said lower portion;

collapsing said container by folding said body member upon itself and folding said body member over itself; and disposing of said container.

12. The method of claim 11, further comprising the steps of:

folding said bottom member over said body member; and folding said top member over said bottom member and said body member.

13. The method of claim 11, further comprising the steps of:

folding said top member over said body member; and folding said bottom member over said top member and said body member.

14. The method of claim 11, wherein said opening said top member comprises the step of removing said top tear strip.

15. The method of claim 11, wherein said opening said bottom member comprises the step of removing said bottom tear strip.

* * * * *